United States Patent [19]

Tornero

[11] Patent Number: 4,930,840

[45] Date of Patent: Jun. 5, 1990

[54] HINGED HEIGHT ADJUSTING DEVICE

[76] Inventor: Lino E. Tornero, 809 Quailmeadow La., Colfax, N.C. 27235

[21] Appl. No.: 375,054

[22] Filed: Jul. 3, 1989

[51] Int. Cl.[5] ..... A47C 7/40

[52] U.S. Cl. ..... 297/353; 297/354

[58] Field of Search ..... 297/353, 354, 355, 356

[56] References Cited

U.S. PATENT DOCUMENTS

| | | | |
|---|---|---|---|
| 2,703,601 | 3/1955 | Wood | 297/354 |
| 2,988,398 | 6/1961 | Hamilton | 297/353 |
| 4,043,592 | 8/1977 | Fries | 297/354 |

FOREIGN PATENT DOCUMENTS

| | | | |
|---|---|---|---|
| 0628881 | 10/1978 | U.S.S.R. | 297/353 |

*Primary Examiner*—Peter R. Brown

[57] ABSTRACT

A height adjusting device for manually locating and automatically locking a movable structure such as a chair backrest at a desired vertical or angular position relative to a fixed structure such as the chair seat. The device comprises two guided and slidably interlocking plates and one lock pin. A first plate is provided with peripheral apertures, a symmetrically disposed first set of hinge members is provided for fixed engagement in said apertures, said first set of hinged members provided with a cylindrical opening for receiving a mating and symmetrically disposed second set of hinge members which are fixedly mounted on the chair backrest. A second plate is mounted on the "J-bar" or "back-upright" of the chair seat and both plates are engaged so as to slide one relative to the other and provide vertical and angular positioning of the chair backrest relative to the chair seat.

10 Claims, 3 Drawing Sheets

FIG. 2
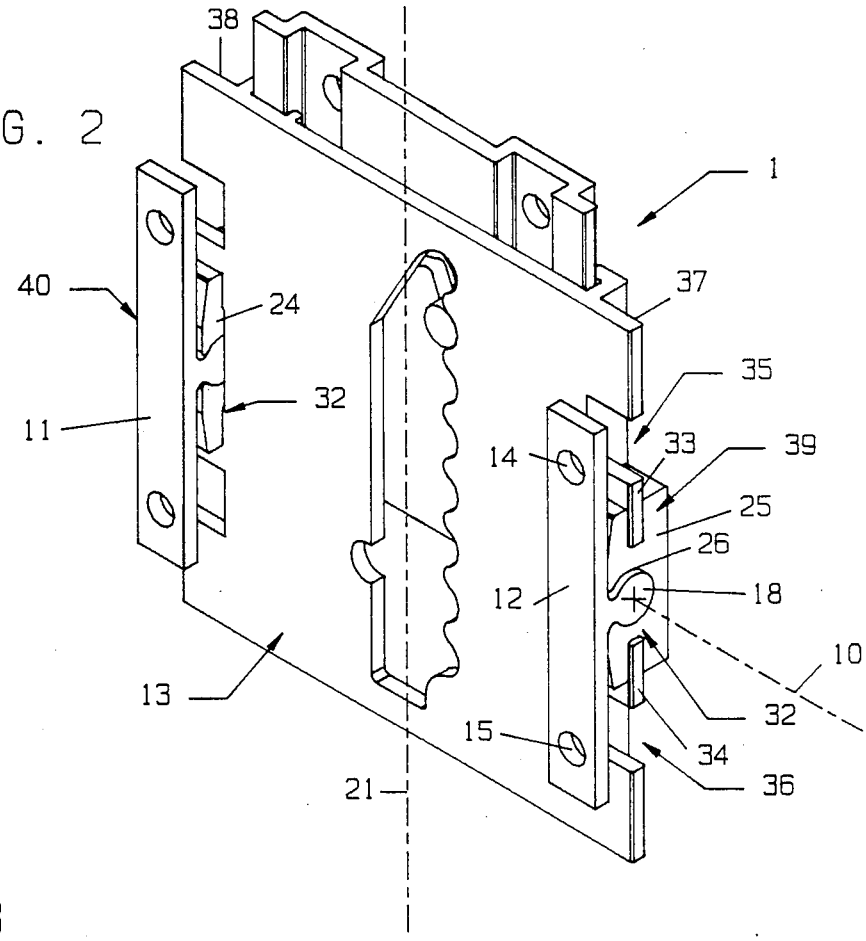
FIG. 3
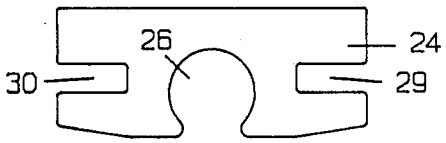
FIG. 6
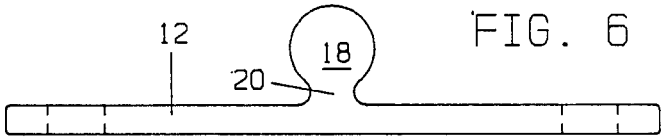
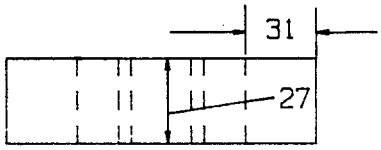
FIG. 4
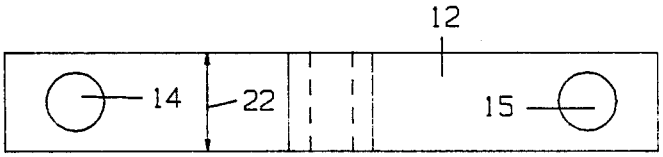
FIG. 7
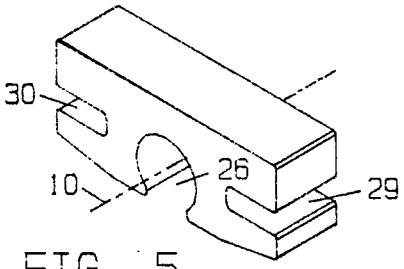
FIG. 5
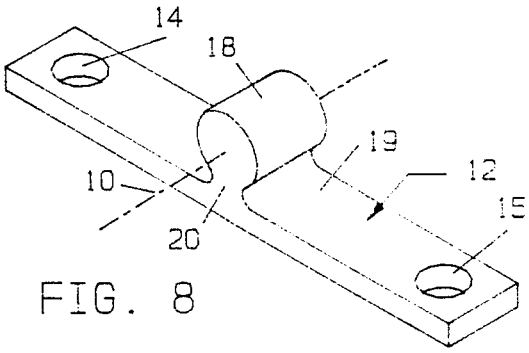
FIG. 8

HINGED HEIGHT ADJUSTING DEVICE

BACKGROUND OF THE INVENTION

1. Field Of The Invention

The invention relates generally to the vertical adjustment of a chair backrest relative to the chair seat such that the backrest can be manually raised or lowered to any of a plurality of selectable positions and releasably locked therein while being able to assume an angular attitude relative to the chair seat and responsive to a person's posture on the chair.

2. Background Objects And Summary Of The Invention

The present invention relates in general to devices which provide for the selective adjustment and positioning of structural components relative to one another. The device is, due to its inherent simplicity, highly suitable for adaptation to various height adjusting purposes.

Accordingly, an object of the present invention is to provide a known height adjusting device, such as is the subject of my U.S. Pat. No. 4,749,230, with hinges on two sides in such a fashion that the hinges can be incorporated with modifications to the existing height adjusting device in a highly economical manner.

The advantages of the device are numerous and it is also an object of this invention to provide for a more fully "ergonomic" seating device. It is also an object to provide a device which is capable of causing the chair backrest to more adequately conform itself to a person's seating habits reducing fatigue and improving task efficiency. The device is particularly useful on chairs equipped with tilting backs; as nOw the backrest can maintain adequate back lumbar support as the person tilts back.

In summary, a chair can be readily equipped with the invention for example by designing a hinge such that one "male" member is a metal extrusion and one "female" member is molded in a self lubricated material or vice versa. One member, preferably the "female" member is made so as to be fixedly engagable and received within apertures or notches symmetrically disposed on the sides of the track plate of the known height adjusting device. The other "male" member is made to be received and rotatably engaged by the "female" member and it is fixed onto the chair backrest. Thus the backrest can be made to change angular position or inclination relative to the chair "back-upright" responsive to a person's seating posture or back contour, while being also able to change height in accordance with the features of the known device.

BRIEF DESCRIPTION OF THE DRAWINGS

In order to better understand the features of the invention the following drawings Of the preferred form of the invention have been provided:

FIG. 2 is a "close up" isometric representation of the height adjusting device provided with hinges;

FIG. 3 is a side view of the hinge female element;

FIG. 4 is a top view of the hinge female element;

FIG. 5 is an isometric view of the hinge female element;

FIG. 6 is a side view of the hinge male element;

FIG. 7 is a top view of the male hinge element;

FIG. 8 is an isometric view of the male hinge element; and

DETAILED DESCRIPTION AND OPERATION OF THE PREFERRED FORM OF THE INVENTION

Figure 1:
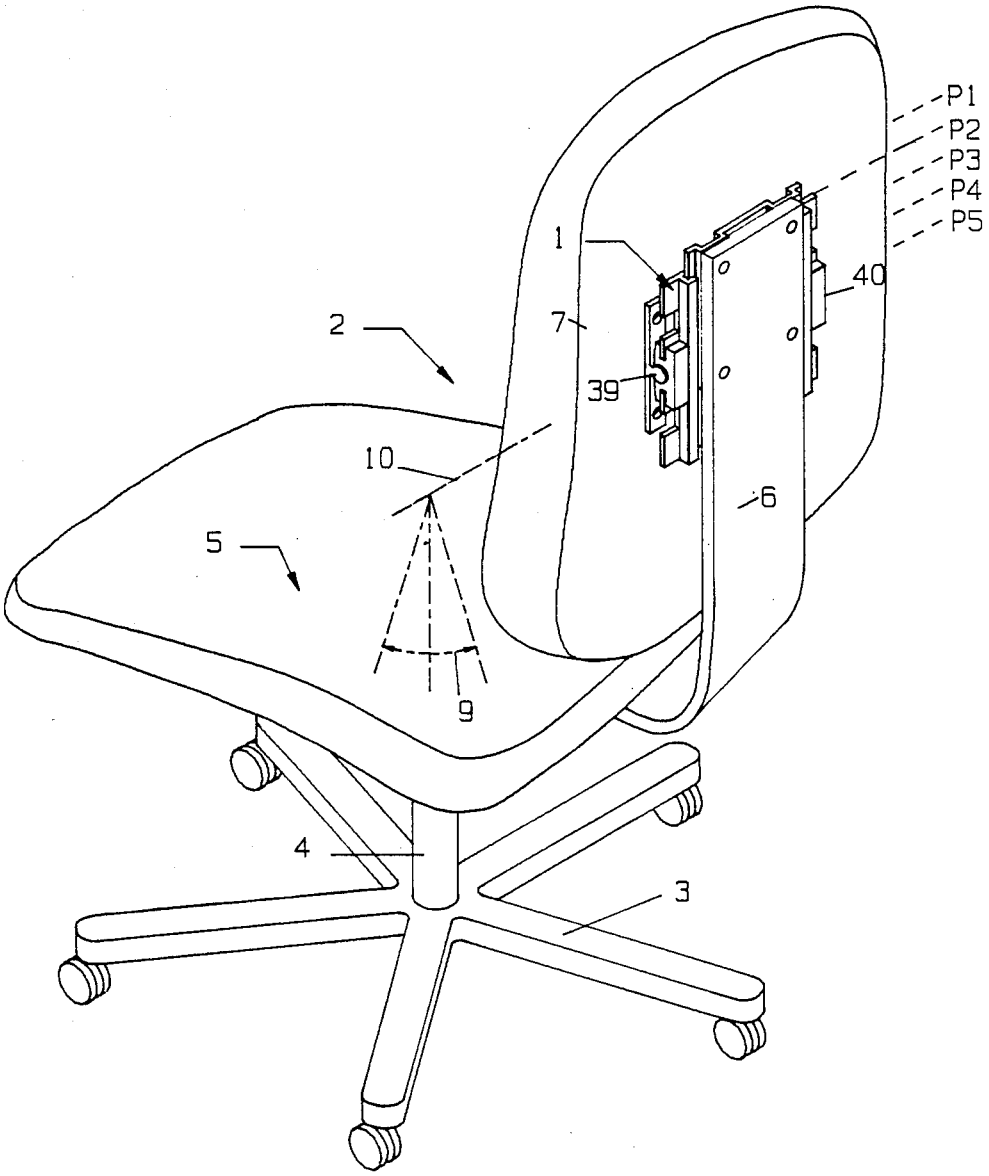
FIG. 1 is a three dimensional representation of a chair equipped with the height adjusting device provided with hinges according to the invention.

The objects of the invention can be achieved in an advantageous manner by the arrangement of elements shown in the accompanying drawings of which the following are detailed descriptions:

Referring to FIG. 1, height adjusting device 1 (hereinafter called the "device") is seen installed on chair 2. Chair 2, comprises supporting base 3, into which is located pedestal 4. Seat 5, is located on and supported by an undercarriage (not shown) to which is attached "J-Bar" or "back-right" 6 for support of backrest 7 by means of device 1. Device 1 provides for manually locating and releasably locking backrest 7 in any of a plurality of vertical positions P1, P2, P3, P4 and P5, in accordance to and in the manner of operation of device 1. Referring also to FIG. 2, because device 1 is now provided with hinges 39 and 40, chair backrest 7 is capable of angular adjustment, within a predetermined number of degrees 9, about a horizontal axis 10. Most chair designs call for a small number of said vertical backrest positions and some measure of backrest angular adjustment and it is understood that device 1 may provide any arbitrary number of height and angular adjustment positions for backrest 7.

Referring now to FIG. 2 through FIG. 8, device 1 seen in an isometric view comprises: male hinge elements 11 and 12. It is understood that male hinge elements 11 and 12 are identically and symmetrically positioned relative to track plate 13 and therefore only element 12 will be described. Male hinge element 12 is provided with holes 14, and 15, for rigid installation onto backrest 7 by suitable means (not shown). Male hinge element 12 is provided with fixed shaft 18 extending the entire width 22 of hinge element 12 and is connected to one side 19 of male hinge element 12 by means of transition zone 20, so that central axis 10 of shaft 18 is perpendicular to vertical axis 21 of device 1 as seen in FIG. 2. Device 1 additionally comprises a pair of symmetrically positioned female hinge elements 24 and 25 to rotatably engage male elements 11 and 12 for angular displacement about axis 10. Female elements 24 and 25 serve analogous functions and therefore only element 24 is described. Female hinge element 24 is made so as to mate and rotatably engage with shaft 18 of male hinge element 12 and to that end female hinge element 24 is provided with a semicircular hub 26 of diameter slightly larger than that of male hinge element shaft 18. Said hub 26 extends the entire width 27 of female hinge element 24. Female hinge element 24 is provided also with grooves 29 and 30 extending the entire width 27 and with depth 31 suitable for pressure fitting of female hinge element 24 within aperture 32 defined by flanges 33 and 34. Apertures 35, 32 and 36, defining flanges 33 and 34, are provided on sides 37 and 38 of track plate 13 of device 1.

Figure 9A:
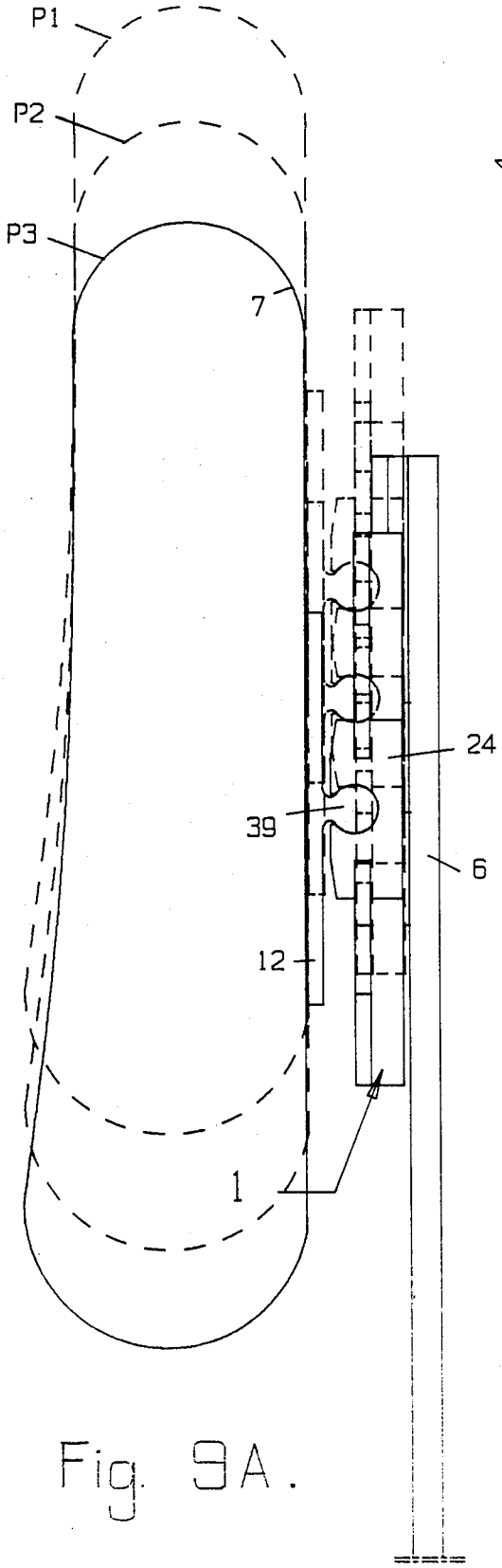
FIGS. 9A and 9B are a partial side view of a chair backrest assembly showing the vertical (9A) and angular (9B) positioning of the device.
Figure 9B:
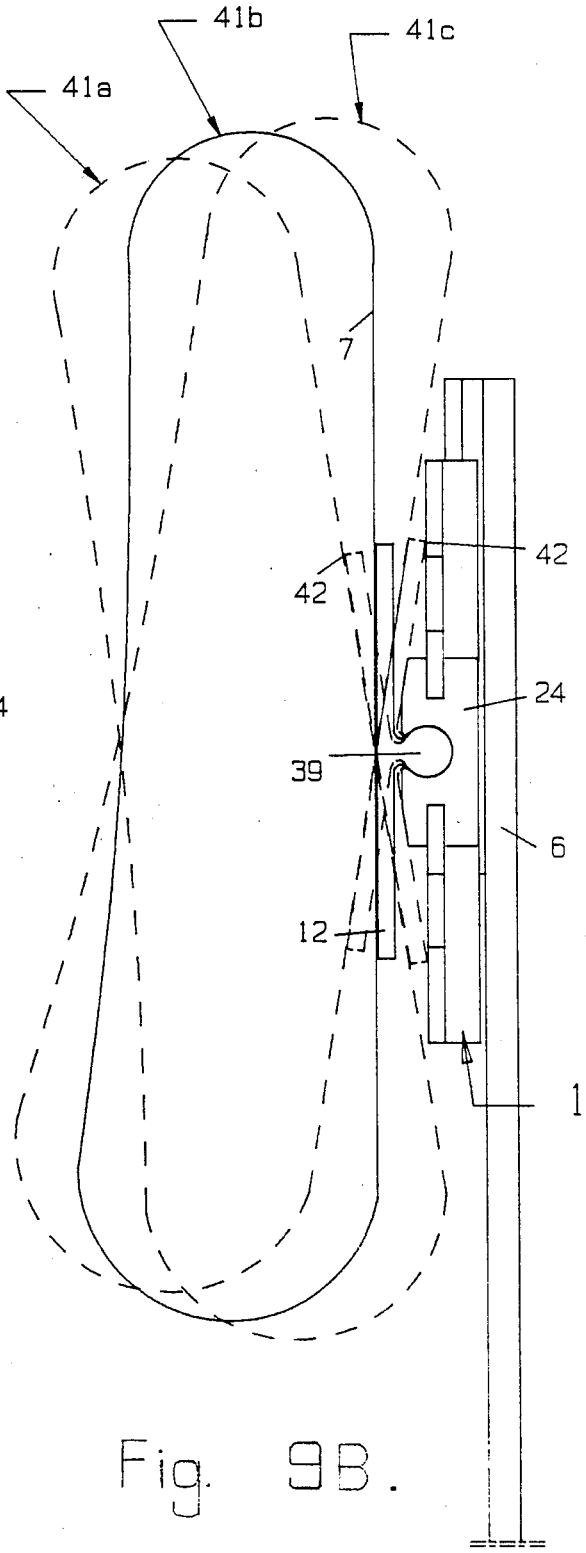

Referring to FIGS. 9A and 9B, device 1 is operated by the individual using chair 2 by applying minimal upward force on the bottom of backrest 7 causing backrest 7 to vertically displace relative to chair 2 and lock in any arbitrarily selected position P1, P2, P3, etc. Immediately upon removal of said upward force, and in accordance with the operation of device 1, backrest 7, being free to angularly displace by virtue of hinges 39 and 40, will assume any of an infinite number of angular positions 41 a, b, or c, within predetermined limits 42 chosen by arbitrary design, said positions 41 being automatically and exclusively selected by the individual's posture on the chair 2.

It will be obvious to those skilled in the art that various changes may be made without departing from the scope of the invention and the invention is not to be considered limited to what is shown in the drawings an described in the specification.

I claim:

1. In a height adjusting device for two structures including a track plate attached to a first structure, said track plate provided with means for slidably receiving a slide plate attached to a second structure, and a lock pin for locking said slide plate relative to said track plate in any of a plurality of releasable positions, the improvement comprising: said track plate having means for attaching a hinge thereto, said hinge attaching means comprising a slot defined by said track plate along its outer edge, a hinge, said hinge defining a groove, said hinge constructed for cooperative engagement with said track plate slot as said hinge groove engages said track plate.

2. A height adjusting device as claimed in claim 1 wherein said hinge includes a male element and a female element, said male and said female element rotatably connected.

3. A height adjusting device as claimed in claim 2 wherein said female element defines a pair of grooves for receiving said track plate.

4. A height adjusting device as claimed in claim 2 wherein said female element defines an axle hub.

5. A height adjusting device as claimed in claim 4 wherein said hub extends the width of said female element.

6. A height adjusting device as claimed in claim 2 and including a shaft, said shaft affixed to said male element.

7. A height adjusting device as claimed in claim 6 wherein said shaft extends the width of said male element.

8. A height adjusting device as claimed in claim 2 wherein said male element defines an aperture, said aperture for affixing said male element to the first structure.

9. In a chair backrest height adjusting device for vertically adjusting the backrest relative to the chair seat, the adjusting device having a track plate affixed to the backrest and a slide plate affixed to the back-upright, said track plate releasably engagable with said slide plate, the improvement comprising: means to hingably join said track plate to said backrest for angular adjustment of said backrest, said hinge means including a pair of male and female elements, said female elements connected to said track plate, said male elements joined to said backrest, one of said female elements defining a hub, one of said male elements including a shaft, said shaft rotatably positioned within said hub whereby said backrest can be angularly adjusted on said back-upright.

10. A chair backrest height adjusting device as claimed in claim 9 wherein one of said female elements defines a pair of opposingly positioned grooves for engagement with said track plate.

* * * * *